US006604713B1

(12) United States Patent
Holmes

(10) Patent No.: US 6,604,713 B1
(45) Date of Patent: Aug. 12, 2003

(54) MODULAR KITES

(76) Inventor: David A. Holmes, 513 Winding Way, Exton, PA (US) 19341

( * ) Notice: Subject to any disclaimer, the term of this patent is extended or adjusted under 35 U.S.C. 154(b) by 5 days.

(21) Appl. No.: 09/723,751

(22) Filed: Nov. 28, 2000

Related U.S. Application Data

(60) Provisional application No. 60/175,413, filed on Jan. 11, 2000.

(51) Int. Cl.[7] ..... B64L 31/06
(52) U.S. Cl. ..... 244/153 R
(58) Field of Search ..... 244/153 R

(56) References Cited

U.S. PATENT DOCUMENTS

| | | | | | |
|---|---|---|---|---|---|
| 51,860 | A | * | 1/1866 | Perrins | 244/153 R |
| 598,777 | A | * | 2/1898 | Greiner | 244/153 R |
| 607,129 | A | * | 7/1898 | Potter | 244/153 R |
| 757,012 | A | * | 4/1904 | Bell | 244/153 R |
| 770,626 | A | * | 9/1904 | Bell | 244/153 R |
| 856,838 | A | * | 6/1907 | Bell et al. | 244/153 R |
| 1,328,143 | A | * | 1/1920 | Fergusson | 244/153 R |
| 2,533,570 | A | * | 12/1950 | Foy | 244/153 R |
| 3,120,367 | A | * | 2/1964 | Rice, Jr. | 244/153 R |
| 3,193,224 | A | * | 7/1965 | Williamson | 135/40 |
| 3,468,503 | A | * | 9/1969 | Snibbe | 244/153 R |
| 3,711,045 | A | * | 1/1973 | Holland, Jr. | 244/153 R |
| 3,948,471 | A | * | 4/1976 | Pearce et al. | 244/153 R |
| 4,078,745 | A | * | 3/1978 | Knight et al. | 244/153 A |
| 4,201,357 | A | | 5/1980 | Gambardella | 244/153 |
| 4,658,843 | A | * | 4/1987 | Raymond | 135/19.5 |
| 4,807,832 | A | * | 2/1989 | Tabor | 244/153 R |
| 5,120,006 | A | * | 6/1992 | Hadzicki | 244/153 R |
| 5,433,401 | A | | 7/1995 | Ricketts | 244/153 |
| 5,727,756 | A | * | 3/1998 | Rowe | 244/153 R |

FOREIGN PATENT DOCUMENTS

| | | | | |
|---|---|---|---|---|
| DE | 4302863-a1 | * | 4/1994 | 244/153 R |
| FR | 374885 | * | 2/1907 | 244/153 R |
| FR | 408064 | * | 7/1910 | 244/153 R |

OTHER PUBLICATIONS

Flavin "*Imaging the Imagined: Tensegrity Structures*", 4 pages, web page for www.frontiernet./~imaging/tenseg1.html (Nov. 6, 1995).
Flavin "*My Humble Graphics Page: Tensegrity Structures* (#2)", 2 pages, web page for www.frontiernet./~imaging/tenseg2.html (Nov. 6, 1995).
Flavin "*My Humble Graphics Page: Tensegrity Structures* (#3)", 3 pages, web page for www.frontiernet./~imaging/tenseg3.html (Nov. 6, 1995).
Flavin "*My Humble Graphics Page: Tensegrity Structures* (#4)", 2 pages, web page for www.frontiernet./~imaging/tenseg4.html (May 6, 1996).
*Playthings magazine*, Oct., 2000, p. 64.
*Playthings* magazine, Sep., 2000, p. 28.

* cited by examiner

*Primary Examiner*—Peter M. Poon
*Assistant Examiner*—Denise J Buckley
(74) *Attorney, Agent, or Firm*—Akin, Gump, Strauss, Hauer & Feld, L.L.P.

(57) ABSTRACT

Various kites are described which can be joined together in any of a variety of larger arrays. Each kite includes a generally tubular integral body having two opposing open longitudinal ends and formed by longitudinally extending flexible planar walls, which intersect one another at lateral edges to define a plurality of joints also extending longitudinally through the body. A plurality of identical elongated spars extending longitudinally between the two longitudinal ends of the body. Each of the spars is more rigid and resilient than the kite body walls. Each longitudinal end of each spar is coupled to the body proximal a separate longitudinal joint end of the body. A central portion of each spar between the longitudinal ends is spaced away from each joint connected with either of the longitudinal ends of the spar. The spars are joined to the fabric bodies by connectors which also permit the kites to be connected together laterally or longitudinally, edge or side to edge or side in linear, two or three dimension arrays.

19 Claims, 6 Drawing Sheets

MODULAR KITES

CROSS-REFERENCE TO RELATED APPLICATIONS

This application is related to U.S. Provisional Application No. 60/175,413 filed Jan. 11, 2000.

BACKGROUND OF THE INVENTION

The present invention relates to a new design for kites of improved construction to prevent breakage and to permit their combination into larger kites in a variety of configurations.

BRIEF SUMMARY OF THE INVENTION

In one aspect, the invention is a kite comprising: a generally tubular integral body having two opposing open longitudinal ends, the body being formed by a plurality of longitudinally extending flexible planar walls, the plurality of walls intersecting one another at lateral edges to define a plurality of joints of the body extending longitudinally through the body; and a plurality of elongated spars extending longitudinally between the two longitudinal ends of the body, each of the spars being more rigid and resilient than the flexible planar walls, each longitudinal end of each spar being coupled to the body proximal a separate longitudinal joint end of the body and each spar having a central portion between the longitudinal ends of the spar spaced away from each joint connected with one of the longitudinal ends of the spar.

In another aspect, the invention is a kite array formed by a plurality of the aforesaid kites joined together.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

U.S. Provisional Patent Application 60/175,413 filed Jan. 11, 2000 is incorporated by reference herein.

Figure 1:
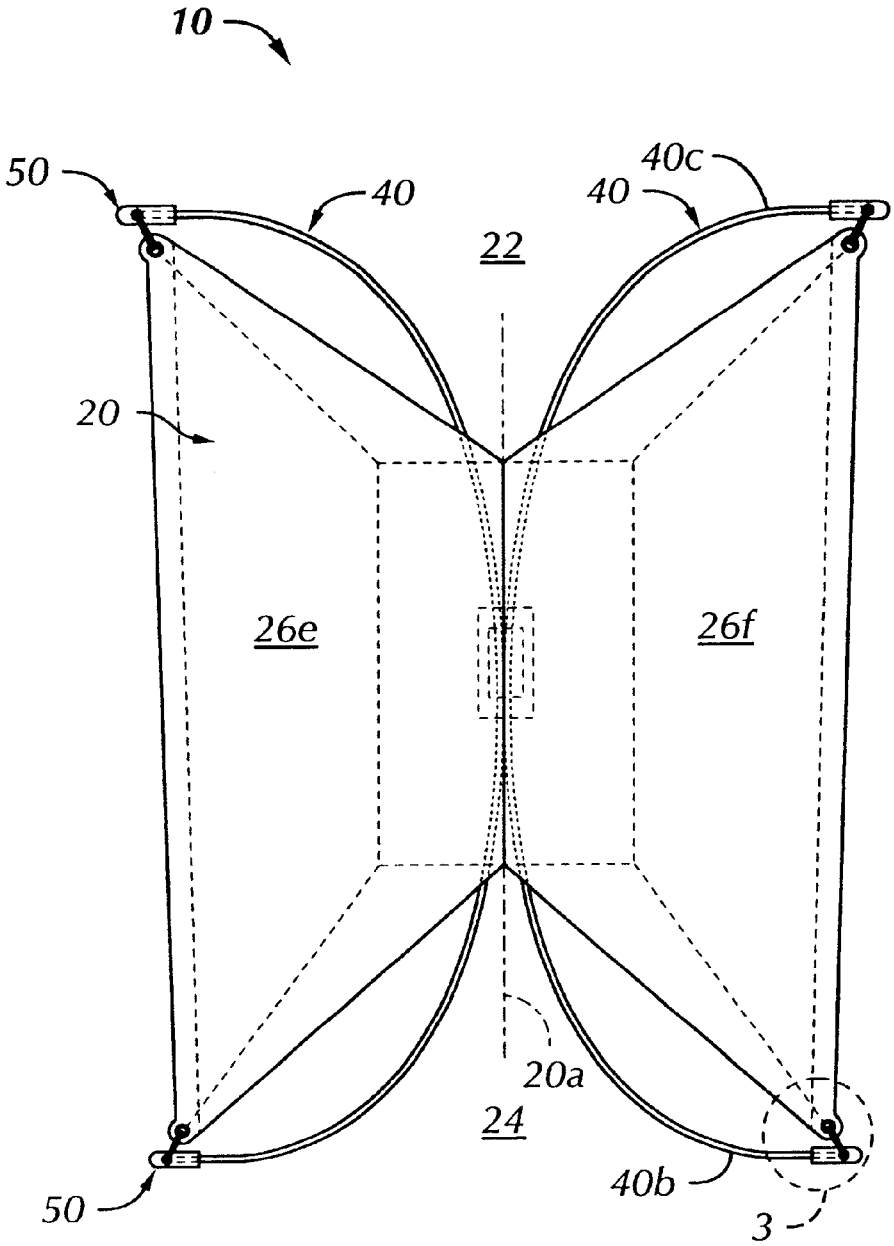
FIG. 1 is a side elevation of a first modular kite of the present invention.
Figure 2:
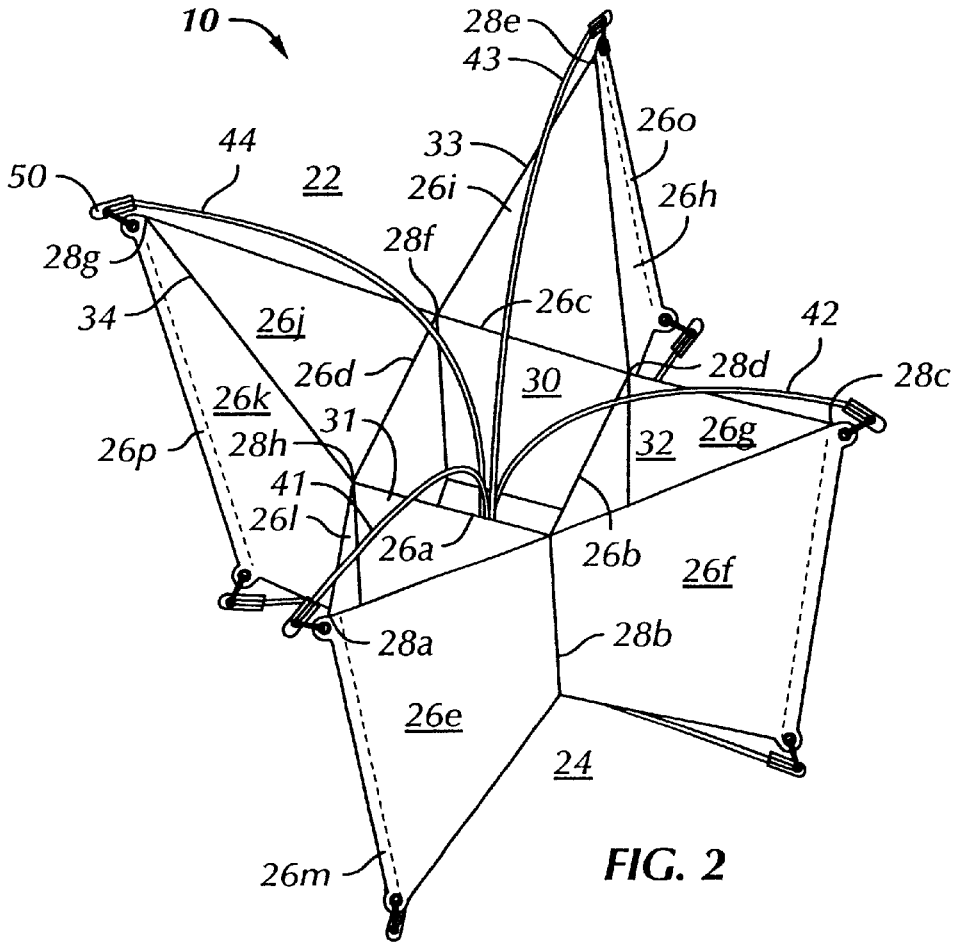
FIG. 2 is a perspective top view of the modular kite of FIGS. 1–2.
Figure 3:
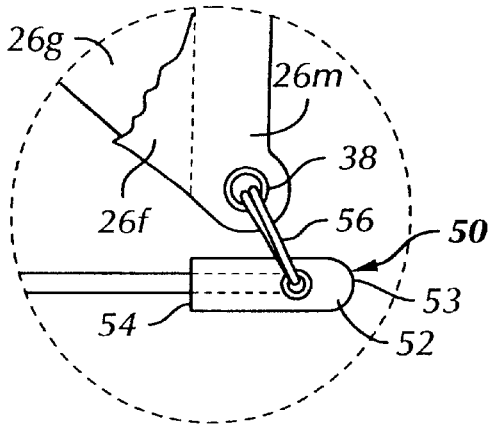
FIG. 3 is a expanded view of area 3 of FIG. 1 depicting a spar end connector and connection to the kite fabric body.

FIGS. 1–3 depict in varying views, a kite 10 in the form of an assembly of parts that comprises a generally tubular integral body or "sail" 20 having two opposing, at least generally open longitudinal ends 22, 24. For convenience, longitudinal end 22 will be referred to as the first end or the upper end, which is its position in some but not all of the figures, while longitudinal end 24 will be referred to as the second or lower end. If it is not immediately apparent from the figures, it should be appreciated that the two ends of the kite 10 and body 20 are identical to one another and symmetric with respect to a central transverse plane as well as to numerous longitudinal central planes through a central longitudinal axis 20*a* of the body 20 and kite 10.

The body 20 is formed by a plurality of longitudinally extending, flexible planar walls 26, which are numbered individually in various figures as 26*a*, 26*b*, 26*c*, etc. The plurality of walls 26 intersect one another at their lateral edges to define a plurality of joints 28, which are individually numbered 28*a*–28*h* in various figures and which also extend longitudinally through the body 10 between the open ends 22, 24. Body 20 preferably includes a plurality of adjoining parallel individual tube portions or "cells". A central tubular portion or cell 30 preferably has a square cross section while each wall 26*a*–26*d* of the square portion forms a base of a separate, triangular tube portion or cell 31–34. The cells 30–34 preferably have substantially identical transverse cross sectional areas. Preferably, narrow walls 26*m*–26*p* are formed by overlapped ends of individual pieces of fabric forming the two walls 26*e*–26*l* of each triangular tube portion extending away from the base walls 26*a*–26*d* to better sustain the loads imposed on the body 20 by spars. Short walls 26 are provided at the outer sides of the four outermost joints 28*a*, 28*c*, 28*e*, 28*g* forming the outermost ends of the triangular tube portions 31–34 to put them at the outer perimeter of the body 20. The walls 26 are preferably made of tightly woven yet flexible fabric such as a ripstop nylon to be wind resistant and provide lift.

The walls 26*a*–26*d* defining the central square tube are as short as the shortest length of the remaining walls 26*e*–26*l* which form the triangular cells 31–34 and which are generally trapezoidal in shape. Suggestedly, the narrow walls 26*m*–26*p* are at least fifty percent longer than the center cell walls 26*a*–26*d* and preferably are at least twice as long or longer. This body design effectively provides openings on all four lateral sides of the body 20 at either longitudinal end 22, 24 to admit air laterally into the cells 30–34 to provide lift between kites that are coupled together along their sides.

The term "flexible" should be understood to mean that the walls 26 are capable of sustaining tensile loads but readily collapse under compressive loads. The walls 26 are joined together by any means suitable for the material selected, including but not limited to stitching, stapling, thermal welding, solvent welding, etc.

The kite 10 further includes a plurality of elongated spars, preferably four identical spars 40. Each spar 40 extends longitudinally between the two longitudinal ends 22, 24 of the body 20. Each of the spars 40 is more rigid and resilient than each of the flexible planar walls 26 of the body 20 and is capable of sustaining a compressive as well as a tensile load. Each spar 40 is also generally straight in an initially unloaded condition and is sufficiently resilient to return to that initially straight state when any imposed loads are removed.

Each spar 40 has a pair of opposing longitudinal ends denoted by the suffixes "a" and "b", respectively for various spars in various figures. Each longitudinal end "a" and "b" of each spar 40 is coupled to the body 20 proximal a separate joint longitudinal end. In particular and as is best seen in FIG. 2, each longitudinal end "a" of each spar 40 is coupled to body 20 proximal one of the joints 28*a*, 28*c*, 28*e* and 28*g* proximal the first or upper longitudinal end 22 of each stated joint. The other longitudinal ends "b" of spars 40 are identically coupled with the body 20 proximal the opposing ends of the same joints 28*a*, 28*c*, 28*e* and 28*g*, respectively, at the opposing, second, lower end 24 of the body 20. As will be seen in later embodiments, the spars do not have to be coupled with opposing ends of the same joint.

While the longitudinal ends "a", "b" of each of the spars 40 might be connected directly with the body 20 for example by being received in pockets (not depicted), provided in the body near the longitudinal ends of the joints coupled with the spars, preferably a plurality of identical connectors 50 are provided to couple each spar end "a" or "b" with the body 20. Referring to FIG. 3, a detail of a portion of FIG. 1, each preferred connector 50 includes a hollow body 52 with one closed end 53 which is further configured by being hollow with an open end 54 to releasably receive one of the spar ends. Each connector 50 also preferably includes a split ring 56 with overlapping ends which can be threaded through a bore provided transversely through the connector body 52 and through an opening in one of the joints or, preferably, through one of the reinforced walls 26 adjoining one of the outer joints 28*a*, 28*c*, 28*e*, 28*g*. Preferably the wall openings are provided by grommets 38 through the walls 26 to better transfer tension from the spars 40 to the body 20 without tearing the wall fabric.

Preferably, each spar 40 is longer than the distance between the longitudinal ends of each joint with which it is coupled to pull the longitudinal ends of those joints 28*a*, 28*c*, 28*e* and 28*g* taut. Each such joint, in turn imposes a compressive load on each spar causing it to bow. Each spar 40 is further preferably of a length so that the central portion of each spar 40 can pass colinearly through or at least adjoining and parallel to the central longitudinal axis 20*a* of the body 20, which is at the center of the central square cell 30. As a result, the central portion between the longitudinal ends "a", "b" of each spar 40 is spaced away from each joint connected with one of the longitudinal ends "a" or "b" of the spar 40 (i.e. 28*a*, 28*c*, 28*e* and 28*g*).

To keep the body 20 from collapsing laterally, the spars 40 are preferably releasably coupled together between their ends, preferably proximal their centers, which can be brought together along the central longitudinal axis 20*a* of the body 20. The spars 40 are preferably releasably secured together by a holder 60 depicted in FIG. 4. Holder 60 has a tubular body 62 which received two of the spars. Holder 60 further preferably includes a clip 64 external to body 62, which is preferably formed by a pair of spaced apart walls 64*a*, 64*b*, projecting outwardly from one side of the body 62. Walls 64*a*, 64*b* are spaced sufficiently far apart and are sufficiently resilient to receive and releasably secure at least one of the two remaining spars 40. The clip 64 can be configured to receive and secure one spar as shown or both remaining spars 41. 42 or another clip provided on one of the other outer walls of the body 62. The holder could be provided with a tubular body receiving only one spar and have three clips or might eliminate the tubular body all together and have four clips. The central portions of the spars 40 can be secured together by any of a variety of other simple fasteners including by not limited to wire twists and fabric fastener rings, which permit the release of at least two of the spars from the remaining spars. If at least two of the spars 40 can be released from the remaining spars, the body 20 of the kite 10 can be collapsed for easy storage and transportation. Preferably the spars are made of a resilient material such as graphite, glass fiber or other resilient composite material rods, spring wire or the like. Avia Sport 0.060 inch diameter "Micro-Carbon Rod" has been successfully used as spars.

Figure 4:
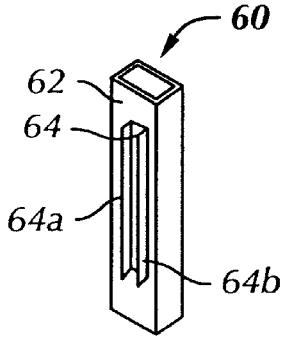
FIG. 4 is an expanded view of a spar center portion connector.
Figure 5:
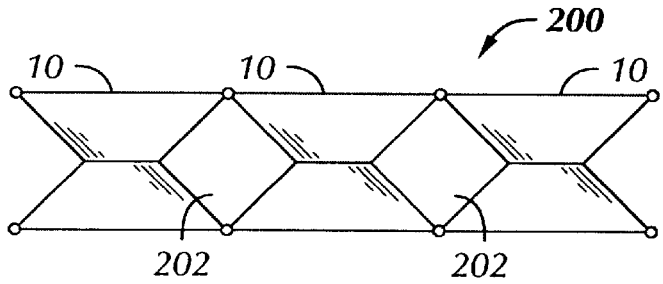
FIG. 5 is a simplified side elevation view depicting a plurality of the above kites coupled together longitudinally in an elongated kite assembly.
Figure 6:
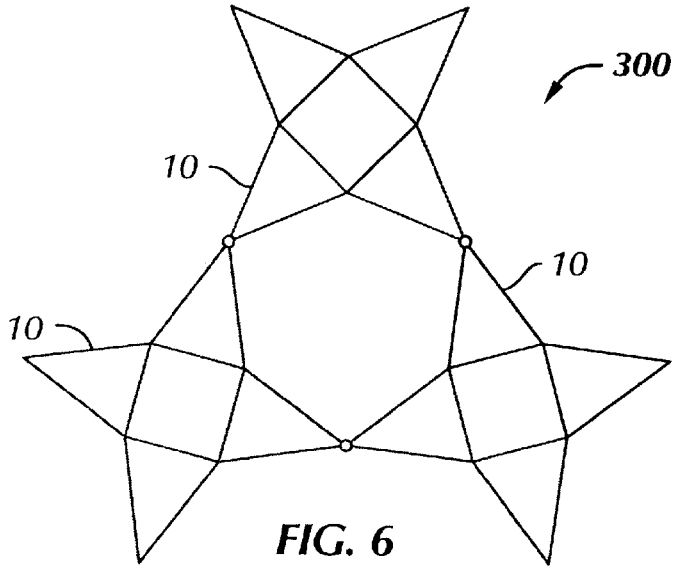
FIG. 6 is a simplified longitudinal end view (along the longitudinal axes) of a plurality of the above kites joined together lateral edge to lateral edge in a linear array.
Figure 7:
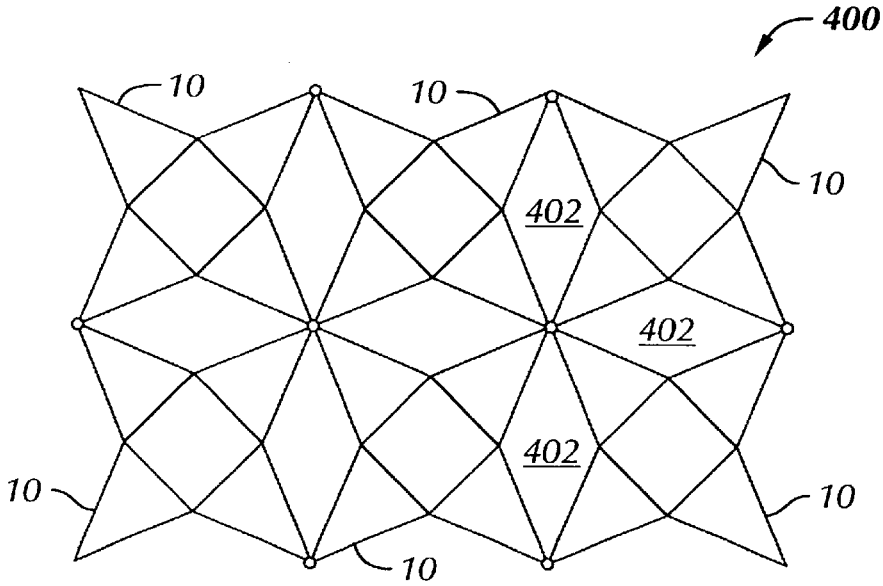
FIG. 7 is a longitudinal end view of a plurality of the above kites joined together lateral side to lateral side in a two dimensional planar array.
Figure 8:
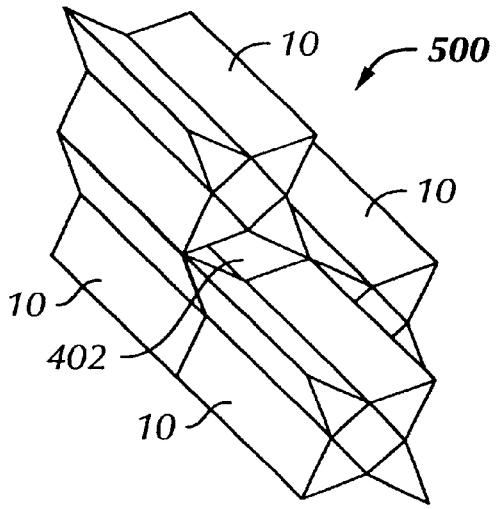
FIG. 8 is a perspective view of a plurality of the above kites joined together in a three dimensional array.

Kite 10 is modular in that it can be combined in multiple ways with similar, preferably identical kites into larger kite structures or arrays. Two or more of the kites 10 can be connected together longitudinal end to longitudinal end as indicated by array 200 in FIG. 5, lateral edge or corner to lateral edge or corner as indicated by array 300 in FIG. 6 and lateral side to lateral side as indicated by array 400 in FIG. 7. As is further indicated in FIG. 7, any three or more of the kites can be connected together lateral side by lateral side in two dimensional planar array as shown in FIG. 4, that can be expanded to any desired degree in either lateral direction. Finally, as is illustrated schematically in FIG. 8, kites 10 may be connected together longitudinally and laterally in any three perpendicular directions, edge to edge or side to side (or even corner to corner) to build three dimensional arrays of virtually any desired arrangement. If desired, as many as eight of the kites 10 can be connected together at a single junction. In other words, each triangular corner at each longitudinal end of each kite 10 is capable of being connected with seven other kites 10. As a result, all sorts of one, two and three dimensional arrays are possible. Longer kites (e.g., 200 in FIG. 5) tend to have more stability than broad or wide kites (e.g., 300 in FIG. 6 and 400 in FIG. 7) in strong winds while broad/wide kites are easier to maintain aloft in light winds. The trapezoidal walls 26*e*–26*l* provide lateral openings 202 between the kites 10 joined together longitudinally as in FIG. 5. The "star" shape of kite 10 also provides openings 302 and 402 between the adjoining sides of side by side assembled kites 10 in assemblies 300 and 400 in FIGS. 6 and 7 to provide lift on walls defining or bordering those openings.

Kites 10 can be joined together in a variety of ways. Most conveniently, the split rings 56 used to couple each connector body 52 to each kite body 20 can be connected directly together as well. Alternatively, or in addition, such rings 56 and/or the grommets 38 they are received in can be coupled together by another connector, e.g. another ring or other form of releasable clip or some type of releasable tie.

Figure 9:
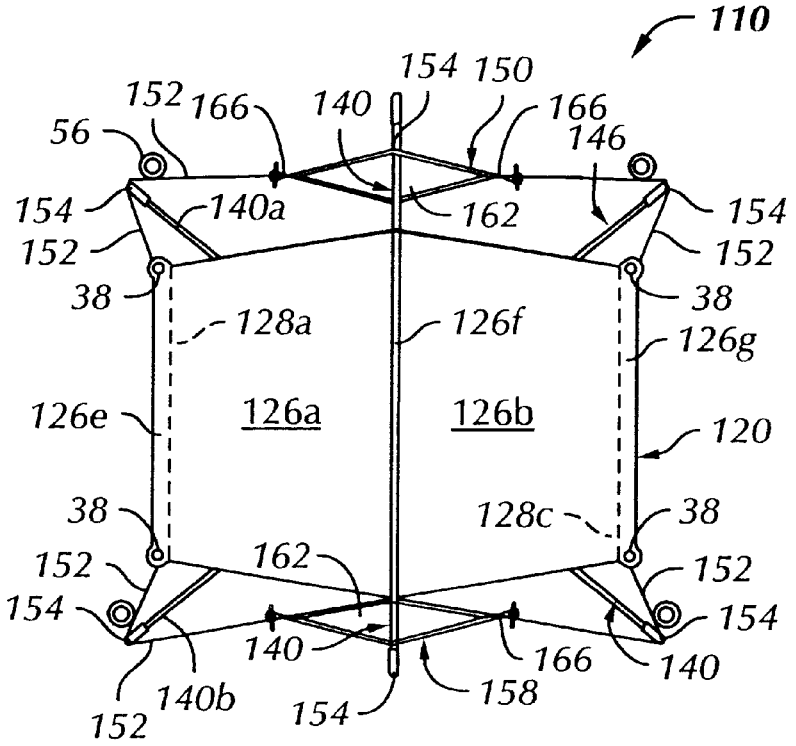
FIG. 9 is a side elevation of a second embodiment kite of the present invention.
Figure 10:
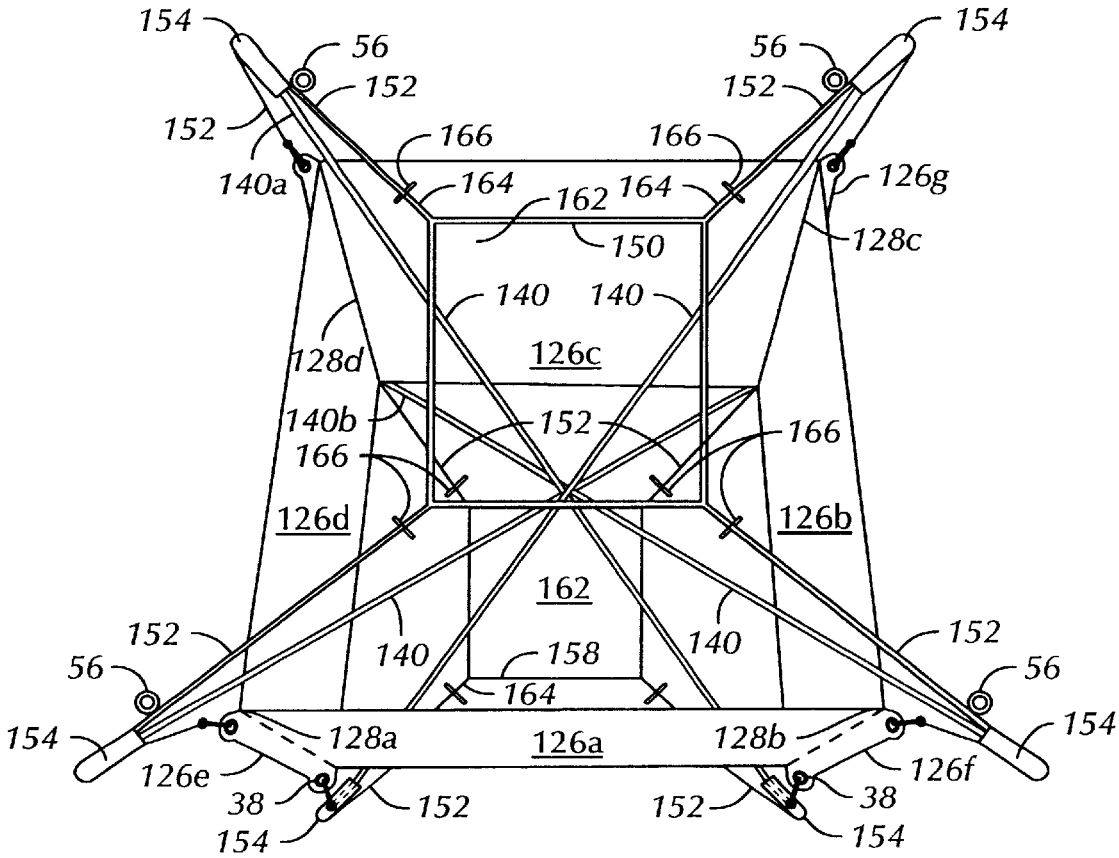
FIG. 10 is a is a top perspective view of the kite of FIG. 9.
Figure 11:
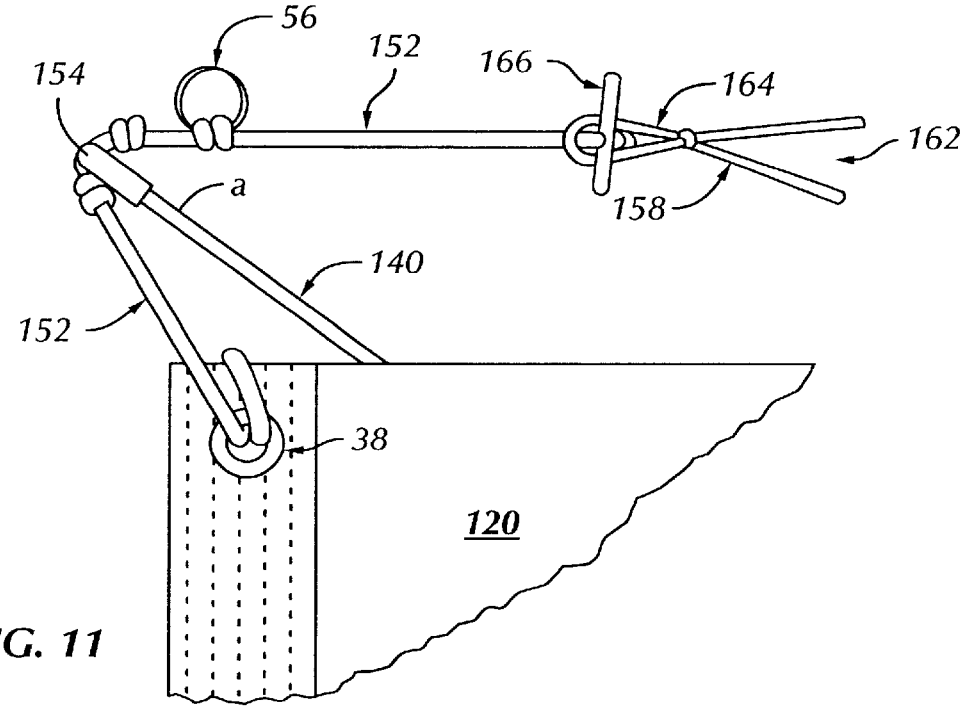
FIG. 11 is a detailed side elevation of the connection at one of the corner joints of the kite of FIGS. 9 and 10.

Referring to FIGS. 9–11, a second embodiment kite 110 of the present invention is depicted. Kite 110 comprises a generally tubular integral body 120 having two opposing, at least generally open longitudinal ends 122, 124. If it is not immediately apparent from the figures, it should be appreciated that the two ends of the kite 110 and body 120 are identical to one another and at least symmetric with respect to a central transverse plane as well as to numerous longitudinal central planes through its central longitudinal axis 120*a*. The body 120 is in the form of a cube with opposing open ends and is again formed by a plurality of longitudinally extending, flexible planar walls 126, which are numbered individually in various figures as 126*a*–126*d*. The plurality of walls 126 intersect one another at their lateral edges to define a plurality of joints 128, which are individually numbered 28*a*–28*d* and which also extend longitudinally through the body 110 between the open ends 122, 124. Preferably, the fabric forming the walls 126*a*–126*d* is doubled over at the joints 128*a*–128*d* to define four outwardly extending narrow walls 126*e*–126*h*.

Again, a plurality of four "rigid" members or spars 140 are arranged to extend longitudinally through the body 120 between and through the longitudinal ends 122, 124. More particularly, spars 140 in kite 110 preferably extend between opposing corners of a cube or other three-dimensional right-angled quadrilateral defined, in part, by the major walls 126*a*–126*d* of the preferred body 120. Preferably, each spar end "a" or "b" is connected to a separate joint longitudinal end by a connector 150, which preferably includes a separate elastic member or "bungie" cord 152, that extends from proximal a joint longitudinal end at one of eight outermost corners of the body 120 and around an adjoining spar end 140*a* or 140*b*. FIG. 11 shows the details of the connection at one of the corners of the body 120 and kite 110. Preferably, a nock 154 is mounted on each tip of each spar 140. Each nock 154 has an outwardly opened end through which each elastic member 152 is threaded. Each elastic member (bungie) 152 has one end secured to the body, for example, by being secured a grommet 38 in one of the outer narrow walls 126*e*–126*h* of the body 120. The four free ends of the four elastic members 152 around each open end 122, 124 of the body 120 are joined to one another, preferably by a flexible yet inelastic end member 158, which is preferably formed by inelastic cord knotted together or otherwise joined to form a square 162 with a loop 164 extending from each corner of the square. The free end of each elastic member 152 is releasably secured with each loop 164. Preferably this is done by the provision of a cleat 166 at the free end of each elastic member 152, which is received in the nearest loop 164. If desired, a ring 56 can be knotted into the bungie 152 between the nock and the cleat for reasons that will be explained. A similar arrangement is provided at the opposing (bottom) open end 124 of the kite 110.

In this embodiment 110, none of the spars 140 is coupled directly or rigidly with any other spar. The spars 140 are the only rigid structural members of the kite 110. The spars 140 are secured together only through the elastic members 152, the two inelastic members 158 and the body 120. The spars 140 are permitted to move relative to one another by the elastic members 152, the flexible end member 158 and the body 120. As a result, none of the spars is subject to any significant bending (torsional) load. Consequently, it is possible to collapse the kite 110 simply by compressing opposing sides of the body 120 together. In this configuration, the bungie cords 152 are stretched and the kite 110 will spring back to its original configuration FIGS. 9 and 10 if disturbed.

Adjoining ends of adjoining parallel spars 140 of the kite 10 in a collapsed configuration can be joined together by suitable means, if desired, to retain the ends together and the kite 110 in the collapsed configuration. For example, each ring 56 can be looped around each pair of adjoining spar ends or around the two ends of each bungie cord 152 extending away from the nock to hold the cord generally parallel to and against the spars. Alternatively, the bungies can be exchanged between adjoining nocks. Finally, the inelastic end member 158 can be removed from the ends of enough of the bungies to relieve the bungies 152 of tension. This will also prevent the kite springing 10 from back to its operating configuration and further reduces the footprint of the collapsed kite 110.

Figure 12A:
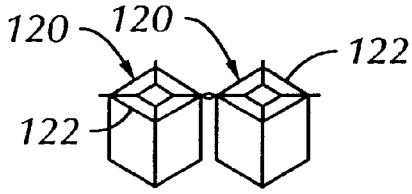
FIGS. 12A–12F depicted in simplified illustration some of the various ways in which the kite of FIGS. 9–11 can be coupled with one another into larger kite arays.
Figure 12B:
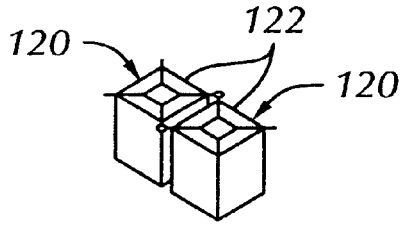
Figure 12C:
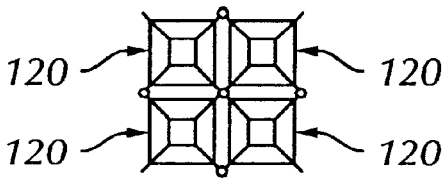
Figure 12D:
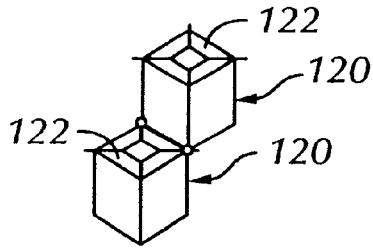
Figure 12E:
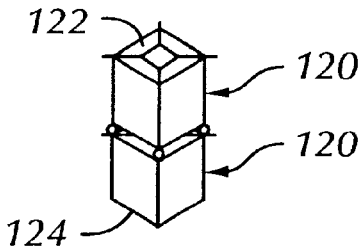
Figure 12F:
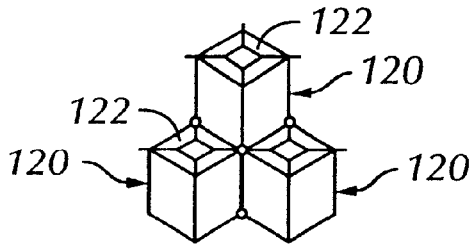

Kite 110 can also be joined with like kites in a variety of three-dimensional structures. Kites 110 of the present invention can be connected together along any corners of their sail 120. They can be connected simply edge to edge (FIG. 12A) or side by side in lines (FIG. 12B) or rectangles (FIG. 12C). They can further be connected longitudinally end to end (side to side along their open sides) top edge to bottom edge (FIG. 12D) or end to end (FIG. 12E). In addition, multi-way connections can be easily made to build kite assemblies, which are several kites deep, high and/or wide. For example, a three-way connection among three kites is shown schematically in FIG. 12F. Up to eight kites can be connected together at a single junction. Kites 110 can be connected together by exchanging bungies. Alternatively, they can be secured together by joining split rings 56 or other by releasable fasteners or ties.

A control line can be secured to one or more of the corners of either of the kite 10, 110, for example, to one of the rings.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A kit comprising:

a generally tubular integral body having two opposing open longitudinal ends, the body being formed by a plurality of longitudinally extending flexible planar walls, the plurality of walls intersecting one another at lateral edges to define a plurality of joints of the body extending longitudinally through the body;

a plurality of elongated spars extending longitudinally between the two longitudinal ends of the body, each of the spars being more rigid and resilient than the flexible planar walls, each longitudinal end of each spar being coupled to the body proximal a separate longitudinal joint end of the body and each spar having a central portion between the longitudinal ends of the spar spaced away from each joint connected with one of the longitudinal ends of the spar; and a further plurality of longitudinally extending, flexible, planar, narrow walls fixedly connected with and extending outwardly from outer sides of the joints of the generally tubular integral body and engaging with longitudinal ends of the spars so as to couple the spars with the generally tubular integral body.

2. The kite according to claim 1, wherein each spar of the plurality is loaded at least in part in compression by the body at the connected spar ends.

3. The kite according to claim 1 wherein each of the plurality of spars extends within the body between the connected joint ends.

4. The kite according to claim 3, wherein at least a portion of each of the plurality of spars are parallel with one another within the body.

5. The kite according to claim 3, wherein each spar is connected with opposing ends of a separate one of the joints of the body.

6. The kite according to claim 3, wherein each of the spars passes proximal to a longitudinal center of the body.

7. The kite according to claim 3, wherein the plurality of spars are coupled together in a bundle at the center of the body.

8. The kite according to claim 3 wherein each of the spars extends between diametrically opposed longitudinal joint ends of the body.

9. The kite according to claim 8 further comprising a plurality of elastic connectors, each longitudinal end of each spar being connected with one of the body joint longitudinal ends with one of the plurality of elastic connectors.

10. The kite according to claim 1 further comprising a plurality of elastic connectors, each longitudinal end of each spar being connected with one of the body joint longitudinal ends with one of the plurality of elastic connectors.

11. A kite comprising:

a plurality of longitudinally extending, flexible walls intersecting one another at lateral edges to define a tubular body including a central tube portion having a polygon shaped cross section and a plurality of outer tube portions positioned around the central tube portion, each outer tube portion sharing at least one common flexible wall with the central tube portion, each outer tube portion having a polygon shaped cross section; and a plurality of resiliently flexible spars extending longitudinally through the central tube portion, each longitudinal end of each spar being coupled with a longitudinal end of a seperate one of the outer tube portions away from each common wall shared with the central tube portion.

12. The kite of claim 11 wherein the central tube portion is quadrilateral in cross sectional shape.

13. The kite of claim 11 wherein each outer tube portion is triangular in cross sectional shape.

14. The kite of claim 11 wherein the central tube portion is square in cross sectional shape.

15. The kite of claim 11 wherein each of the outer tube portions extending outwardly away from its common wall with the central tube portion is longer longitudinally than the central tube portion.

16. The kite of claim 11 further comprising a narrow wall extending outwardly from each outer tube portion and away from the central tube portion, each opposing end of each spar being connected with an opposing longitudinal end of one of the narrow walls.

17. The kite of claim 11 further comprising a split ring at each end of each spar.

18. The kite of claim 11 further comprising a split ring at each longitudinal end of each narrow wall.

19. The kite of claim 11 further comprising a connector at each longitudinal end of each outer tube portion releasably receiving a longitudinal end of one of the spars.

* * * * *